United States Patent [19]

Wassenaar

[11] 4,223,421

[45] Sep. 23, 1980

[54] SEPARABLE HINGE

[76] Inventor: Adelbert D. Wassenaar, 167 Rosemary, SE., Grand Rapids, Mich. 49507

[21] Appl. No.: 941,970

[22] Filed: Sep. 13, 1978

[51] Int. Cl.[2] ..... E05D 7/10

[52] U.S. Cl. ..... 16/172; 16/126

[58] Field of Search ..... 16/171, 172, 174, 128 R, 16/126

[56] References Cited

U.S. PATENT DOCUMENTS

| | | | |
|---|---|---|---|
| 1,632,116 | 6/1927 | Buss | 16/171 |
| 2,555,473 | 6/1951 | Deaton | 16/174 X |
| 2,794,208 | 6/1957 | Scroggihs | 16/171 |
| 2,933,016 | 4/1960 | Kunde et al. | 16/171 X |
| 3,242,523 | 3/1966 | Daley | 16/171 |
| 3,431,591 | 3/1969 | Betso | 16/171 |
| 3,471,874 | 10/1969 | Dixon | 16/171 X |
| 3,605,718 | 9/1971 | Winters | 16/171 X |
| 3,889,999 | 6/1975 | Mackintosh | 16/171 X |

*Primary Examiner*—C. J. Husar
*Assistant Examiner*—Moshe I. Cohen
*Attorney, Agent, or Firm*—Glenn B. Morse

[57] ABSTRACT

This hinge assembly includes normally interengaged leaves, one of these supporting a D-shaped shaft in fixed position. The opposite leaf has bearing sections with open sectors that admit only the minor transverse dimension of the shaft in a praticular relative angular position of the leaves. An abutment on the first leaf prevents disengagement of the second leaf in a position one hundred and eighty degrees from that position.

4 Claims, 7 Drawing Figures

FIG. 1
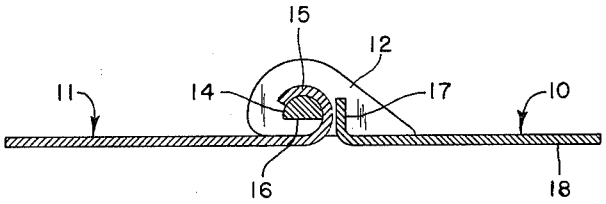
FIG. 2
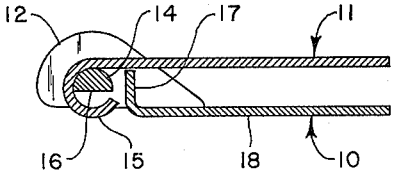
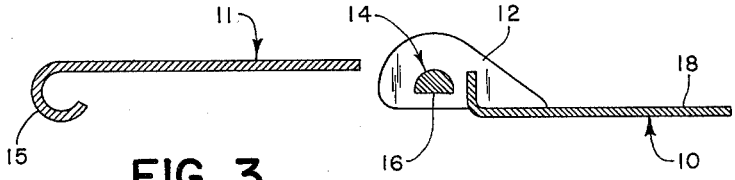
FIG. 3
FIG. 4
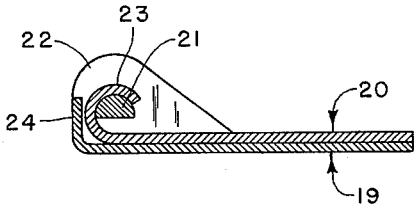
FIG. 5
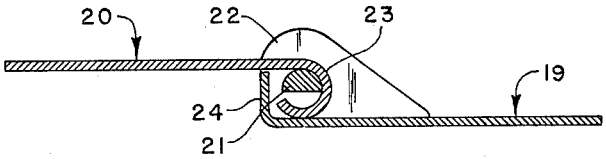
FIG. 6
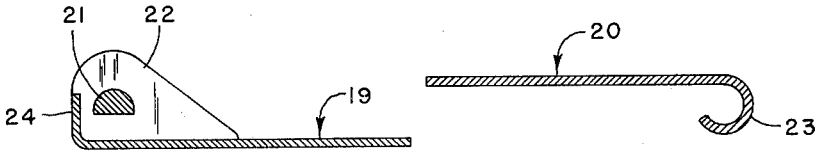
FIG. 7
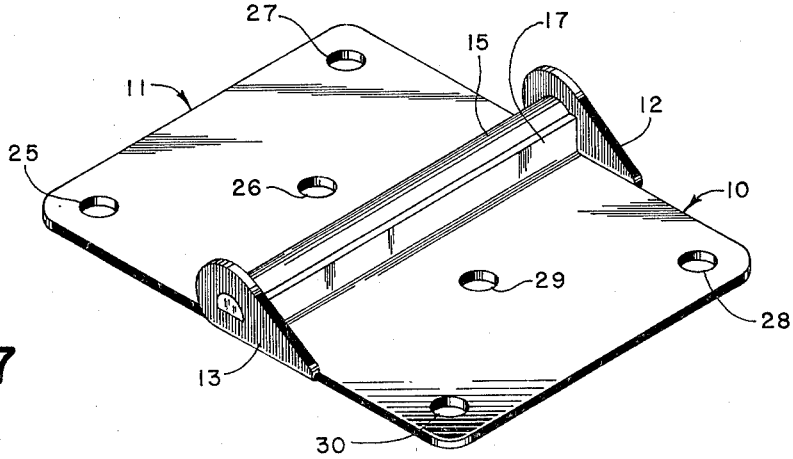

SEPARABLE HINGE

BACKGROUND OF THE INVENTION

Separable hinges have been developed to provide for situations where it becomes desirable to have a door or other hinged element removable from the structure that supports it. The hinge leaves can thus remain permanently secured in position. A variety of structural configurations have been devised to provide this feature, typical examples of these being noted in the following patents:

| | | |
|---|---|---|
| 1,632,116 | Buss | 1927 |
| 2,223,676 | Dinsmore, et al. | 1940 |
| 2,732,581 | Heck | 1956 |
| 3,471,874 | Dixon | 1969 |
| 3,416,185 | Peterson | 1968 |
| 878,545 (German) | Sohne | 1953 |

The common feature in most disengageable hinge assemblies centers in a pivot shaft that has a D-shaped cross-section, and is fixed with respect to one of the hinge leaves. The opposite leaf has bearing sections adapted to rotate on this shaft, and these bearing sections are open across a sufficient sector to admit the thickness of the shaft, measured in a direction perpendicular to the flat side. This gap width in the bearing sections is insufficient to permit the passage of the major diameter of the shaft. The hinge leaves are thus disengageable in a particular angular relationship. Normally, this configuration will provide similar disengageability in a position one hundred and eighty degrees opposite from that position. In many applications, it is undesirable to have the hinge components disengageable in more than one position. This invention is directed at providing single-position disengageability in a hinge capable of relative hinge articulation in excess of one hundred and eighty degrees.

SUMMARY OF THE INVENTION

A hinge leaf supports a D-shaped shaft in fixed position. The opposite hinge leaf has discontinuities in the bearing sections providing for admission of the minimum transverse dimension of the shaft in a particular relative angular position between the hinge leaves. The first leaf has an abutment preventing disengagement of the leaves in a position one hundred and eighty degrees from the position first referred to.

DESCRIPTION OF THE DRAWINGS

FIG. 1 is a sectional view on a plane perpendicular to the axis of the hinge assembly, showing the hinge in an extended position.

FIG. 2 is a view of the FIG. 1 assembly, with the two leaves folded, or overlaid, in a position one hundred and eighty degrees from the FIG. 1 position.

FIG. 3 illustrates the direction of separation of the hinge leaves from the FIG. 2 position. FIG. 4 illustrates a modified form of the invention, with the hinge leaves in the overlaid position.

FIG. 5 is a view of the FIG. 4 modification, with the hinge leaves extended in a position one hundred and eighty degrees from that of FIG. 4.

FIG. 6 illustrates the disengagement of the hinge components of the FIG. 4 modification.

FIG. 7 is a perspective view of the FIG. 1 assembly.

DESCRIPTION OF THE PREFERRED EMBODIMENTS

Referring to the drawings, the hinge illustrated in FIGS. 1, 2, and 3 includes the leaves 10 and 11. The leaf 10 has the side brackets 12 and 13 (refer to FIG. 7) which support the D-shaped shaft 14 in fixed position. The leaf 11 has one or more bearing sections 15 normally embracing the shaft 14, and this bearing section has a gap sufficient to permit the passage of the thickness of the shaft 14 measured in a direction perpendicular to the flat face 16. This condition is presented in a particular angular relationship of the leaves illustrated in FIG. 2. In this position, it is obvious that the leaf 11 is disengageable from the leaf 10 by movement to the left, as shown in FIG. 3. The presence of the abutment 17 prevents disengagement of the leaf 11 in the FIG. 1 position. This abutment is sufficiently spaced from the shaft 14 to admit the thickness of the material forming the bearing 15 without interference. In the simple form of the construction shown in FIGS. 1 through 3, the abutment 17 is simply a flange of material bent up from the same material constituting the base 18 of the leaf 10. The brackets 12 and 13 are preferably formed in the same manner.

Referring to the modification shown in FIGS. 4, 5, and 6, the leaf 19 is hinged to the leaf 20 by the shaft 21 supported in fixed position by the brackets 22 integral with the leaf 19. The bearing section 23 on the leaf 20 has a gap just wide enough to permit passage of the minor transverse dimension of the shaft 21 when the leaves are in the relative angular position shown in FIG. 5. In this position, the leaves are disengageable through the movement illustrated in FIG. 6. The presence of the abutment 24 prevents disengagement of the hinge in the FIG. 4 position. Normally, the leaves of both forms of the hinge assembly are provided with holes as indicated at 25–27 and 28–30 in FIG. 7 to receive mounting screws. Particularly in the form of the invention shown in FIGS. 4–6, these screw holes should be bevelled to accept flat head screws to permit the leaves to be placed in the FIG. 4 position.

I claim:

1. A separable hinge assembly including first and second leaf members and a pin normally interengaging said leaf members to provide a pivotal connection, said hinge assembly having a freedom of articulation of substantially one hundred and eighty degrees, wherein the improvement comprises:

pin bracket means on said first leaf member receiving said pin in fixed relationship with respect to said first leaf member;

bearing means on said second leaf member normally embracing said pin around a sector greater than one hundred and eighty degrees, and having a gap adapted to provide a withdrawal passage for said pin in only one predetermined angular relationship of said leaf members; and abutment means on said first leaf member spaced from said pin to admit said bearing means between said pin and said abutment means said gap being disposed to provide withdrawal with said leaf members in substantially parallel relationship.

2. A hinge assembly as defined in claim 1, wherein said leaf members are additionally in overlapping relationship.

3. A hinge assembly as defined in claim 1, wherein said pin has a D-shaped cross-section, and the flat surface thereof is parallel to said first first leaf member, said gap having an opening greater than the width of said pin normal to said flat surface, and less than the width of said pin parallel to said flat surface.

4. A hinge assembly as defined in claim 3, wherein said abutment means is substantially normal to said first leaf member, and extends from said leaf member a distance less than the distance from said first leaf member of a plane tangent to the most remote side of said pin.

* * * * *